United States Patent [19]

Stenz

[11] 4,239,324

[45] Dec. 16, 1980

[54] TERMINAL BLOCK FOR PRINTED CIRCUITS

[75] Inventor: Paul P. Stenz, Detmold, Fed. Rep. of Germany

[73] Assignee: C. A. Weidmuller KG, Detmold, Fed. Rep. of Germany

[21] Appl. No.: 60,702

[22] Filed: Jul. 25, 1979

[30] Foreign Application Priority Data

Jul. 29, 1978 [DE] Fed. Rep. of Germany ..... 2833313

[51] Int. Cl.[3] ..... H01R 9/22; H01R 23/72

[52] U.S. Cl. ..... 339/198 G; 339/17 C; 339/198 H

[58] Field of Search ..... 339/19 B, 113 B, 126 R, 339/17 C, 272 A

[56] References Cited

U.S. PATENT DOCUMENTS

| | | | |
|---|---|---|---|
| 3,474,392 | 10/1969 | Norden | 339/198 G X |
| 3,992,074 | 11/1976 | Rymer | 339/198 GA X |
| 4,171,152 | 10/1979 | Geiseler | 339/17 C X |

FOREIGN PATENT DOCUMENTS

| | | | |
|---|---|---|---|
| 23689 | 9/1962 | German Democratic Rep. | 339/198 E |
| 829683 | 3/1960 | United Kingdom | 339/198 G |

*Primary Examiner*—Richard B. Lazarus
*Assistant Examiner*—Eugene F. Desmond
*Attorney, Agent, or Firm*—Pollock, Vande Sande & Priddy

[57] ABSTRACT

An electrical terminal block for a printed circuit has upper and lower rows of terminals in a stepped configuration, the terminals in the upper row being laterally offset relative to those in the lower row by half the width of a terminal. The front edges of the upper row terminals rest on the terminals of a bottom row, and retaining plates are provided at the ends of the rows. The terminals are all of the same type. If only a single lower row is provided the rear of the upper row can be supported on a supporting wall. Alternatively a second lower row can be provided.

8 Claims, 6 Drawing Figures

TERMINAL BLOCK FOR PRINTED CIRCUITS

This invention relates to terminal blocks for printed circuits, assembled from individual terminals.

Copending UK Patent Application No. 26078 (U.S. Ser. No. 926,984; Canadian Application No. 307,581) describes and claims an electrical terminal for printed circuits, comprising an insulating casing with an internal space, a connector bar in the internal space of the casing having at an end thereof a tag projecting from the casing, through a first aperture provided in the casing, for connection to a printed circuit, and clamping means in the internal space of the casing for clamping an external conductor to the connector bar, said clamping means including a clamping screw, the casing being provided with a second aperture for insertion of a said external conductor, and having a first external surface substantially parallel to the axis of the clamping screw and opposite the said second aperture, a second external surface substantially parallel to the insertion direction for an external conductor, and a third external surface disposed between, adjoining, and oblique with respect to the said first and second surfaces, the first aperture being in the said third external surface and being defined by surfaces in the casing which are respectively substantially parallel to the first and second external surfaces and diverge towards the third external surface of the casing. In this terminal it is merely necessary to arrange the connecting tag differently in accordance with requirements, more particularly to bend it differently in order to obtain various connecting facilities.

It is the object of the present invention to provide a terminal block such that it is possible to obtain a duplex construction with a single terminal type with one row of terminals disposed over at least one second row of terminals so that a desired number of poles can be obtained in the smallest possible space using a single terminal type.

It is known to construct terminal blocks from individual terminals, with a second row of terminals disposed above a bottom row of terminals in stepped, offset configuration, to improve accessibility to the terminal screws, and with a lateral offset equal to half the terminal width between the bottom and top terminal rows so that the connected conductors of the top terminal row do not prevent access to the screws of the bottom terminal row. It is a disadvantage in known terminal blocks of this kind that separate, different terminal types are required for the construction of the bottom and top rows of terminals.

The present invention provides an electrical terminal block for printed circuits, comprising: a plurality of terminals each having an insulating casing with an internal space, a connector bar in the internal space of the casing having at an end thereof a tag projecting from the casing, through a first aperture provided in the casing, for connection to a printed circuit, and clamping means in the internal space of the casing for clamping an external conductor to the connector bar, said clamping means including a clamping screw, the casing being provided with a second aperture for insertion of a said external conductor, and having a first external surface substantially parallel to the axis of the clamping screw and opposite the said second aperture, a second external surface substantially parallel to the insertion direction for an external conductor, and a third external surface disposed between, adjoining, and oblique with respect to the said first and second surfaces, the first aperture being in the said third external surface; the said terminals being disposed in a stepped configuration comprising one upper row of said terminals above at least one bottom row of said terminals with a horizontal offset of the terminals in the upper row relative to those in the bottom row(s) equivalent to half the width of one terminal, with the front edge of the terminals of the top row bearing on the terminals of a bottom terminal row; and retaining plates which are offset in accordance with the lateral offset of the terminal rows and are latched at least on the terminal block ends. The use of suitably offset retaining plates, at least on the lateral terminal block ends, and conveniently, in the case of terminal blocks of substantial length, also at predefined distances within the terminal block, and supporting the top terminal row either on two bottom terminal rows or, if only one bottom terminal row is provided, on a separate support wall disposed between the retaining plates, makes it possible to construct such terminal blocks with any desired number of poles from a single terminal type, merely by using the special retaining plates and, where appropriate, a support wall the construction of which is also extremely simple.

Preferably, each terminal block is as set forth in the aforesaid copending application. It is to be understood that in this case the terminal block can be built up with the individual terminals in any of the several spatial positions to which they are adapted.

In the present case it is merely necessary to use a somewhat modified connecting tag, more particularly a downwardly extended tag, for the upper terminal row, while retaining one and the same terminal type.

Embodiments of the invention are described hereinbelow with reference to the accompanying drawings in which.

Figure 1:
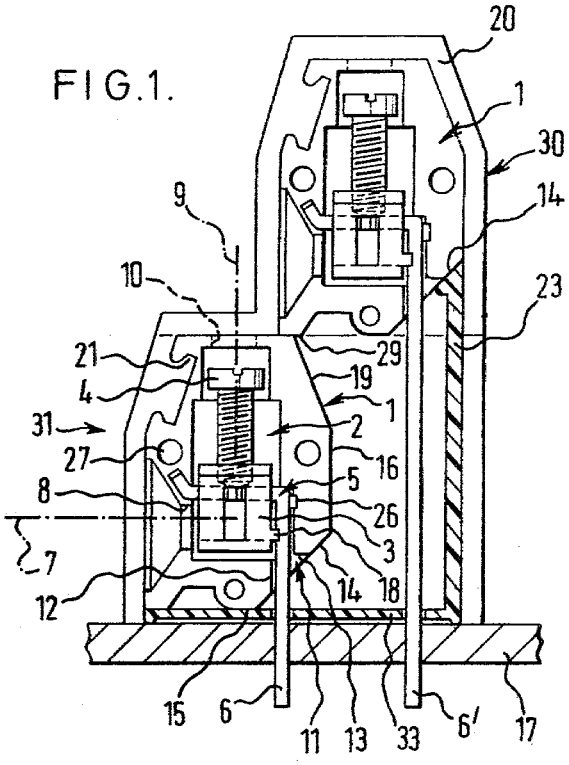
FIG. 1 is a section through a first terminal block according to the invention.
Figure 2:
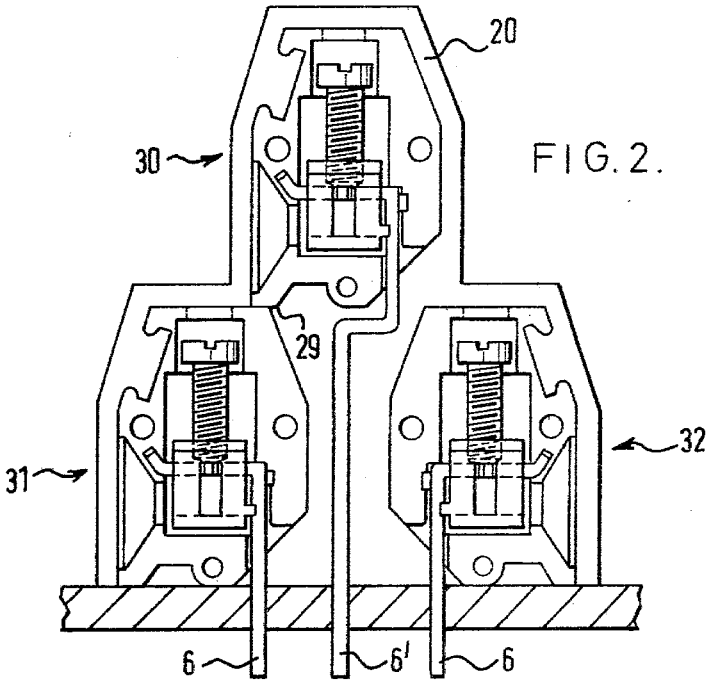
FIG. 2 is a section through another terminal block according to the invention.
Figure 3:
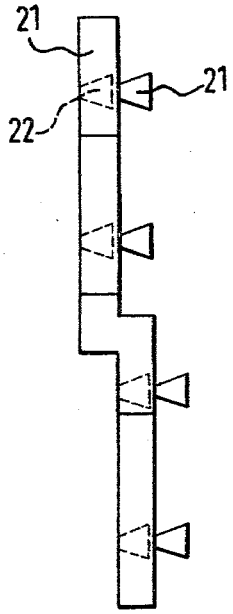
FIG. 3 is a detail view of a retaining plate of the terminal block according to FIG. 1.
Figure 4:
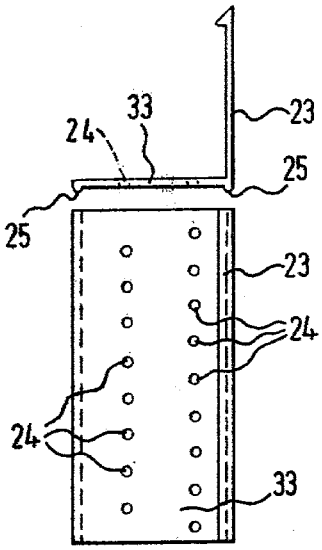
FIG. 4 is a plan view of a support wall of the terminal block according to FIG. 1.

FIGS. 1 and 2 show terminal blocks assembled from individual terminals 1 each as set forth in copending application No. 26078/78 (US Ser. No. 926,989, now U.S. Pat. No. 4,171,152, issued Oct. 16, 1979; Canadian application No. 307581). Each terminal has an insulating casing 19 of moulded insulating plastics material. The casing is generally slab-like in shape, with a generally rectangular internal space 2 which is open to one of the major external faces of the casing. This space accommodates the conducting components of the terminal and in use is closed by the casing of an adjacent terminal, or a separate plate. The casing has a recess 21 to accommodate identifying plates.

The internal space 2 of the casing contains a clamping sleeve or saddle 3 of bent sheet metal, a clamping screw 4 which is threaded in one side of the saddle, and a connector bar 5 extending through the saddle and adjacent to the tip of the screw. The saddle 3 is preferably sheet metal bent to form a tube of generally rectangular cross section, and is capable of moving within the space 2, in a direction perpendicular to the intermediate part of the connector bar which lies within the saddle. One open end of the saddle faces an aperture 8 through which an external electrical conductor (not shown) can be inserted into the saddle, between the bottom wall of the latter, and the intermediate part of the connnector bar. By tightening of the clamping screw, the clamping saddle 3 is moved along the screw so that the inserted conductor is clamped between the bottom of the saddle and the intermediate portion of the connector bar, the latter remaining fixed in position. The axis of the end of the inserted conductor, during insertion and when clamped, extends along or parallel to the chain line 7. The head of the screw is accessible through a further opening 10 in the casing.

The external surfaces of the casing in which the openings 8 and 10 are provided are perpendicular to one another, as are the direction of insertion of the conductor indicated by the line 7, and the axis 9 of the screw. The casing also has an external surface 15 (which in the illustrated embodiment is a pair of co-planar surface portions) parallel to the line 7 and opposite the surface containing the opening 10; an external surface 16 parallel to the screw axis 9 and opposite the surface containing the opening 8; and an oblique external surface 14 which is intermediate between the surfaces 15 and 16 and directly adjoins each of the said surfaces and is at an angle preferably of 45° thereto.

An opening 11 extends between the surface 14, and that corner of the internal space 2 that is closest to the surface 14. The opening 11 has a boundary surface 12 parallel to the axis 9 and the surface 16, and a boundary surface 13 parallel to the line 7 and the surface 15. The surfaces 12 and 13 diverge towards the surface 14.

The connector bar has, in addition to the intermediate portion, an end portion which is bent obliquely away from the portion and extends away from the line 7 and is located in a corresponding recess in the casing. The connector bar also has a second end portion bent at right angles to the portion and extending, parallel to the axis 9, to the opening 11. A tag 6 integral with the end portion projects through the opening 11 for insertion into and connection to the printed circuit board 17.

The saddle 3 may have one or more guide lugs 18 locating the end portion of the connector bar, and may have a guide slot which engages a guide lug on the intermediate portion of the connector bar, whereby the saddle is guided during its movement along the clamping screw when the latter is rotated. The end portion of the connector bar may have a locating projection which is located in a recess 26 in the casing.

Identical terminals are used to form a top terminal row 30 and a bottom terminal row 31 of the terminal block illustrated in FIG. 1. The individual terminals are latched to each other in conventional manner, e.g. by means of sockets in the terminal casings, which receive studs 27 integral with the casings or separate connecting pins. Of course, the connnecting tags 6' of the terminals in the top row are longer so that they can reach the plate 17, and are laterally offset from those of the bottom row.

Figure 5:
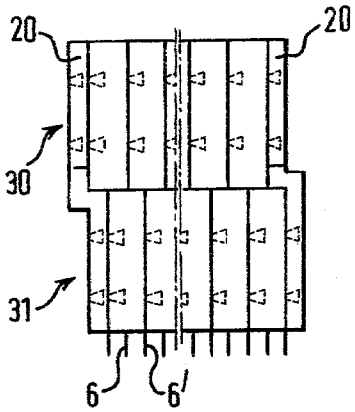
FIG. 5 is a schematic front view of a terminal block according to FIG. 1.
Figure 6:
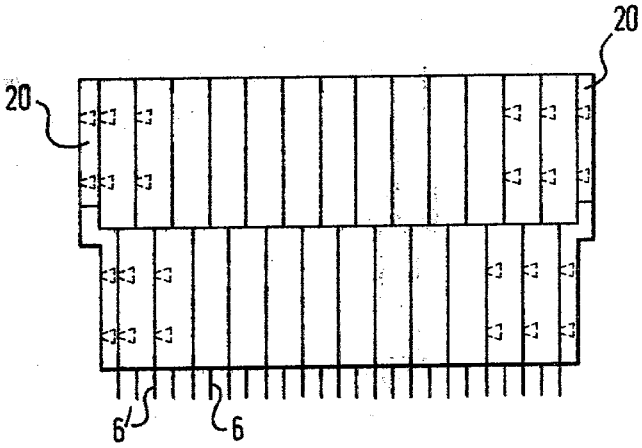
FIG. 6 is a schematic front view of a further terminal block.

In the embodiment illustrated in FIG. 1 only one bottom terminal row 21 is provided as well as one top terminal row 30. The top terminal row is rearwardly offset in stepped configuration above the bottom terminal row. As can be seen by reference to FIGS. 5 and 6 the two terminal rows are laterally offset by half the width of one individual terminal along the horizontal extent of the block, so that the conductors inserted into the openings 8 of the terminals of the top row do not conceal the access openings 10 for the screws 4 of the bottom row. An identical stepped configuration as well as a corresponding lateral offset configuration between the top and bottom terminal rows is also provided in the embodiment illustrated in FIG. 2 in which a second bottom row 32 is provided, stepped to the rear of the top row 30.

Retaining plates 20, the external contour of each is adapted to the number of terminal rows, are provided at the ends of the terminal block. The retaining plates 20 are provided with detent holes 22 and detent studs 21 to permit latching to the rows of terminals. The retaining plates 20 are offset by half the terminal width, as between the top and bottom terminal rows, to match the lateral offset of these rows.

If the top terminal row has the same number of terminals as the bottom terminal row or rows (FIG. 5) the ends of the terminal block will be provided with retaining plates 20 which are both offset in the same direction. If the top terminal row is to include one more terminal than the bottom terminal row (FIG. 6) the two retaining plates are offset in opposite directions.

In the terminal block illustrated in FIG. 2, in which one top terminal row 30 is disposed above two bottom terminal rows 31,32, the front edge 29 of the top terminal row bears on the front bottom terminal row 31 while the rear region remains unsupported. The retaining plates 20 in this embodiment are stabilized by their bottom width and by the very stable connection obtained by two terminal rows so that adequate retention is provided for the top terminal row.

In the embodiment illustrated in FIG. 1, the top terminal row 30 is supported above only one bottom terminal row 31 and bears with its front edge 29 on the bottom terminal row. To provide adequate stabilization in the rear region of the top terminal row the rear edge of the terminals of the top terminal row is supported at the surface 14 on a separate support wall 23. The latter is of L section, its bottom region comprising a lateral portion 33 forming a perforated mask and having two rows of holes 24, for additional guiding and retention of the terminal tags 6 associated with the terminals of the two terminal rows; said additional guiding and retaining means are particularly useful for the long connecting tags of the upper row. By contrast to the illustrated embodiment it is also possible for the portion 33 to be shortened so that it does not extend beneath the bottom terminal row 31 and is provided with only one row of holes 24 for guiding the long connecting tags of the upper row. Bearers 25, by means of which the support wall 23 together with the portion 33 bear on the circuit board 17, are situated beneath the portion 33 so that gas ducts are formed in a desirable manner.

It should be noted that in the spatial position of the terminals chosen for FIGS. 1 and 2, the connecting tags are downwardly pointing extensions of the bar 5 and therefore project beyond the external surface 15 of the insulating casing 1. In accordance with the characteristics of the individual terminals, the terminal blocks can also be built up in spatial configurations of individual terminals in which the connecting tags 6 project perpendicularly beyond the sloping external surface 14 in a different corresponding bent configuration of the bar 5, or project perpendicularly beyond the external surface 16.

I claim:

1. An electrical terminal block for printed circuits, comprising: a plurality of terminals each having an insulating casing with an internal space, a connector bar in the internal space of the casing having at an end thereof a tag projecting from the casing, through a first aperture provided in the casing, for connection to a printed circuit, and clamping means in the internal space of the casing for clamping an external conductor to the connector bar, said clamping means including a clamping screw, the casing being provided with a second aperture for insertion of a said external conductor, and having a first external surface substantially parallel to the axis of the clamping screw and opposite the said second aperture, a second external surface substantially parallel to the insertion direction for an external conductor, and a third external surface disposed between, adjoining, and oblique with respect to the said first and second surfaces, the first aperture being in the said third external surface; the said terminals being disposed in a stepped configuration comprising one upper row of said terminals above at least one bottom row of said terminals with a horizontal offset of the terminals in the upper row relative to those in the bottom row(s) equivalent to half the width of one terminal, the terminals of the upper row having front edges bearing on the terminals of a bottom terminal row; and retaining plates which are offset in accordance with the horizontal offset of the terminal rows and are latched at least on the terminal block ends.

2. A terminal block as claimed in claim 1 in which the said first aperture is defined by surfaces in the casing which are respectively substantially parallel to the first and second external surfaces and diverge towards the third external surface of the casing.

3. A terminal block as claimed in claim 1 having two bottom rows of terminals.

4. A terminal block as claimed in claim 1 in which only one bottom row is provided and the terminals of the upper row bear at their rear edges on a support wall provided between the retaining plates.

5. A terminal block according to claim 4, wherein the support wall has a bottom end provided with a laterally extending portion which has at least one row of holes for guiding the connecting tags of the terminals of the top row.

6. A terminal block according to claim 5, wherein the underside of the said portion has front and rear edges provided with bearers by means of which it can bear on a circuit board.

7. A terminal block according to claim 1 wherein the same number of terminals is provided in the upper row as in the bottom row or each bottom row, and the retaining plates are offset in the same direction.

8. A terminal block according to claim 1 wherein the upper row contains one more terminal than the bottom row or rows, and the retaining plates are offset in opposite directions.

* * * * *